United States Patent [19]

Nelson

[11] Patent Number: 4,934,660

[45] Date of Patent: Jun. 19, 1990

[54] DEVICE FOR RAISING AND LOWERING LOADS

[75] Inventor: Donald D. Nelson, Red Wing, Minn.

[73] Assignee: D B Industries, Inc., Red Wing, Minn.

[21] Appl. No.: 104,639

[22] Filed: Oct. 2, 1987

[51] Int. Cl.[5] ..... B66D 3/08

[52] U.S. Cl. ..... 254/394; 254/399; 254/408; 254/267; 182/239

[58] Field of Search ..... 254/268, 267, 391, 394, 254/408, 399; 182/236, 239

[56] References Cited

U.S. PATENT DOCUMENTS

| | | | |
|---|---|---|---|
| 723,231 | 3/1903 | Benedict | 254/391 |
| 811,440 | 1/1906 | Roberts | 254/391 X |
| 848,905 | 4/1907 | Jenson | 254/391 |
| 903,433 | 11/1908 | Baker | 254/401 X |
| 1,636,273 | 7/1927 | Baker | 254/291 |
| 1,764,512 | 6/1930 | Hume | 254/391 |
| 1,971,511 | 8/1934 | Stahl | 254/399 |
| 3,759,346 | 9/1973 | Brda . | |
| 4,213,019 | 7/1980 | Houp | 254/271 X |

FOREIGN PATENT DOCUMENTS

| | | | |
|---|---|---|---|
| 8607343 | 12/1986 | PCT Int'l Appl. . | |
| 288418 | 4/1928 | United Kingdom | 254/391 |
| 409441 | 5/1934 | United Kingdom . | |
| 2135266 | 8/1984 | United Kingdom . | |

OTHER PUBLICATIONS

"Man Safety Belt", Sanko Industry Co., Ltd., no date available.

"Rollgliss—The Universal Rescue and Utility System", International Safety Equipment Inc., no date available.

"With Rollgliss Handy Lives can be Saved", Olympia Triumph Import-Export Limited, no date available.

"News Release—Universal Rescue and Utility System", Rollgliss, International Safety Equipment Inc., no date available.

"Rescue and Descent Gear Rollgliss", International Safety Equipment Inc., no date available.

"Rollgliss—The Universal Rescue & Utility System for Raising & Lowering from Heights, Depths, Confined Spaces", International Safety Equipment Inc., no date available.

"Rollgliss—The Universal Rescue & Utility System", International Safety Equipment Inc., no date available.

"With Rollgliss Handy Lives can be Saved", Rettungsgerate BRDA, Olympia Triumph Import-Export Limited, no date available.

"IKAR—Automatic-Lasthalter fur Arbeitssicherheit und Rationalisierung", no date available.

"Rescue Master-Portable Rescue System by Moxham Industrial-the Height Safety Specialists", Moxham Industrial Pty. Ltd., no date available.

"Rollgliss 200", International Safety Equipment Inc., no date available.

*Primary Examiner*—Katherine A. Matecki

*Attorney, Agent, or Firm*—Moore & Hansen

[57] ABSTRACT

A device for raising and lowering a load has a braking device, brake indicator, and a one-way pulley. The braking device uses a wedge-shaped braking element to stop the advancement of a cord. The brake indicator indicates when the braking device is enabled. The one-way pulley allows the load to be lowered at a steady rate and uses a braking element positioned between a stop pin and a braking surface.

15 Claims, 3 Drawing Sheets

FIG. 1
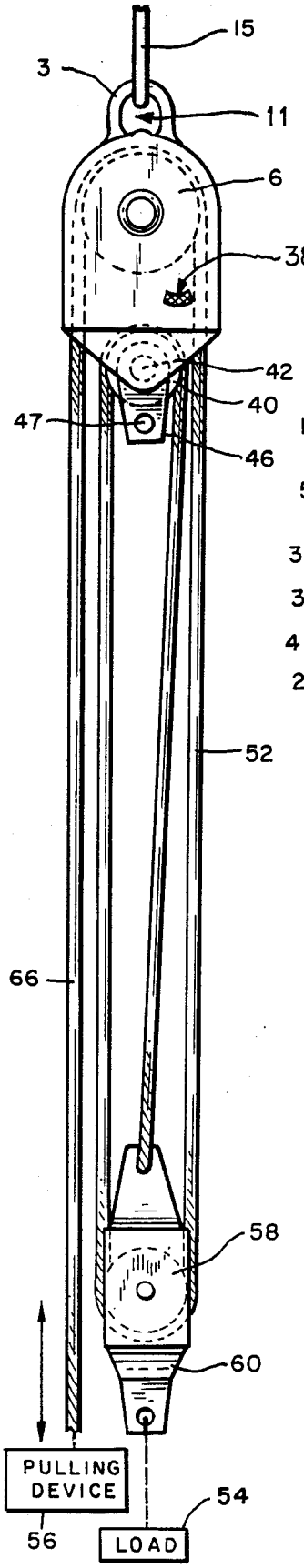
FIG. 2
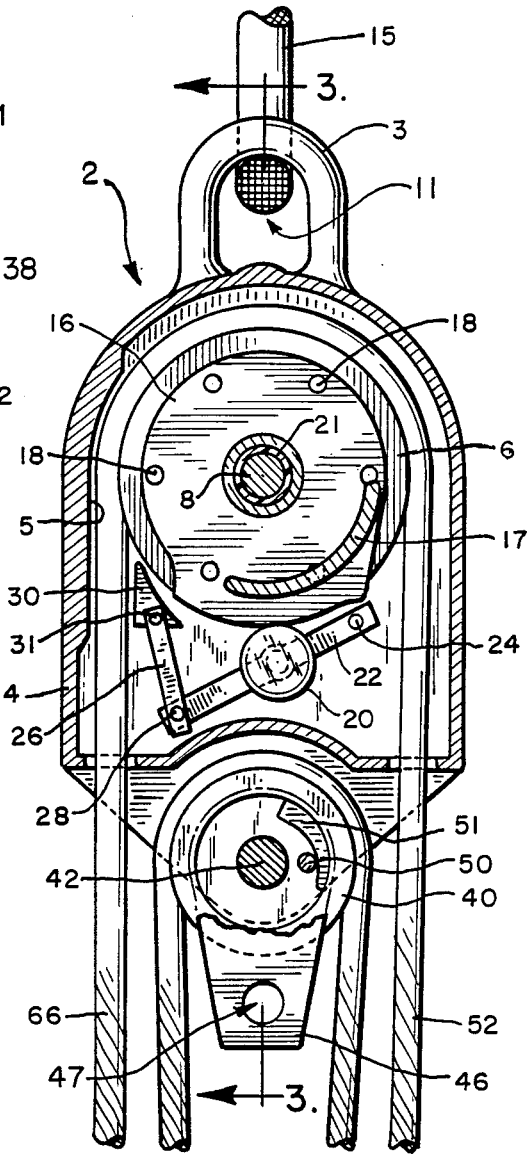
FIG. 3
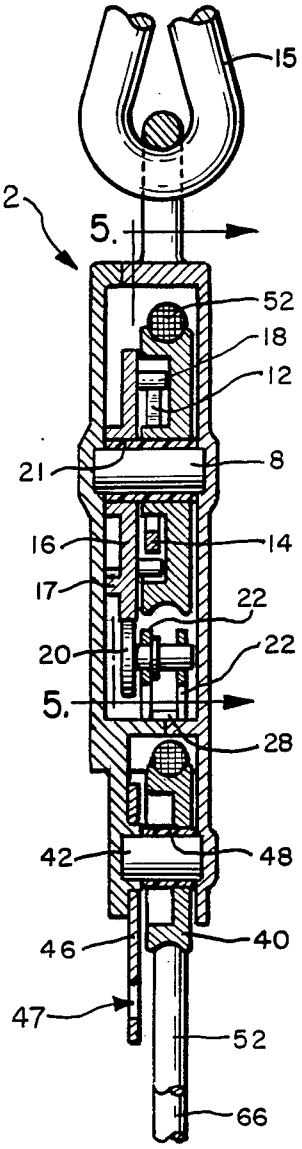
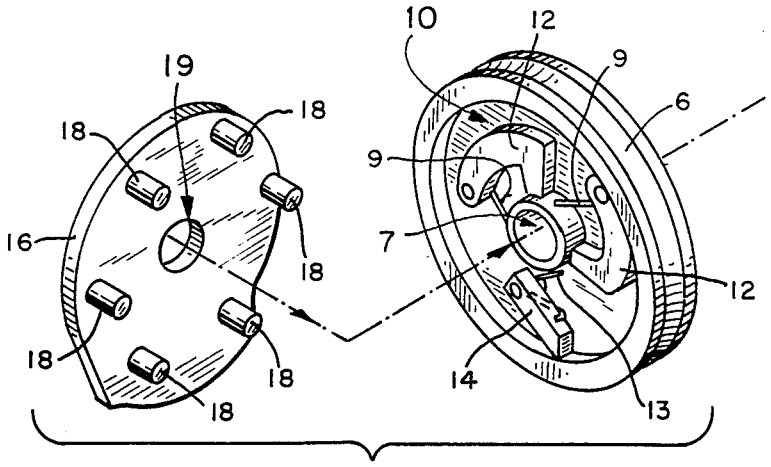
FIG. 4

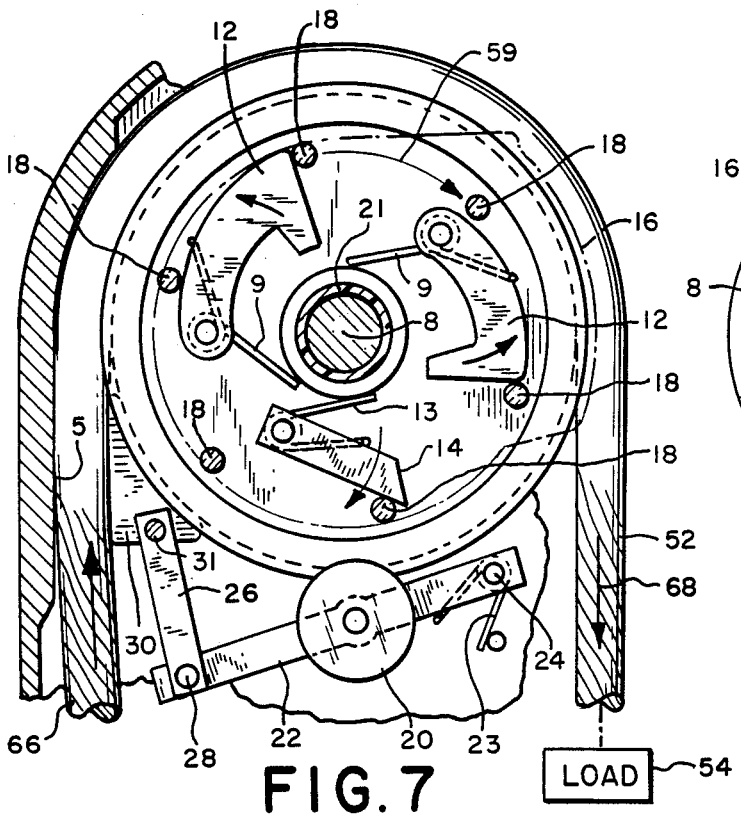
FIG. 7
FIG. 10
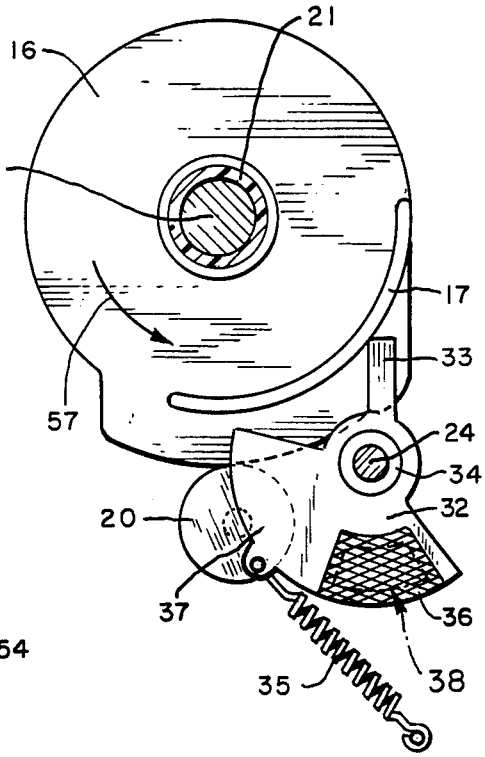
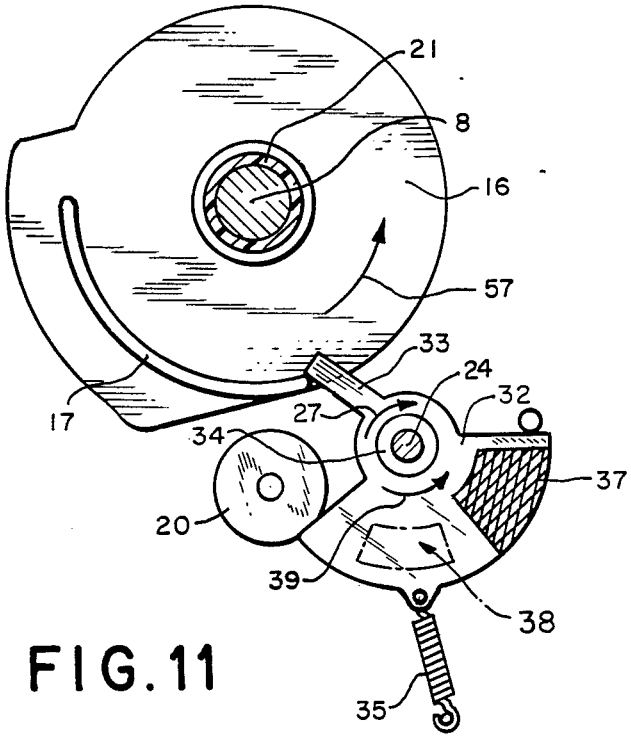
FIG. 11

DEVICE FOR RAISING AND LOWERING LOADS

BACKGROUND OF THE INVENTION

This invention relates to devices for raising and lowering loads; particularly devices used by skyscraper workers, construction workers, and rescue personnel to raise and lower equipment or people.

A typical device uses a rope with one end connected to the load and the other end connected to a man, who exerts the force necessary to raise and lower the load. As the rope is pulled by the man, the load is raised. Release of the rope by the man causes the load to be lowered. If the man merely holds onto the rope, then the load is neither raised nor lowered, but is held stationary at a constant height. As a safety feature, a typical device has a brake that restrains the rope in one direction. One type of brake uses a stationary clamp to hold the rope between the clamp and a pulley. The clamp has teeth and thus prevents the rope from moving in one direction.

A typical braking system is activated in two ways. First, the braking system is periodically activated as the rope is pulled by the man. In this way the man can stop pulling at selected points and the rope will be locked in one direction. Second, the braking system is activated if the load is lowered at a rate above a selected threshold. In this way, if the man releases the rope at a point where the brake is not engaged, then the braking system will stop the load from falling once the load has reached a selected speed.

A typical raising and lowering device uses several pulleys to reduce the amount of force required to raise the load. At least one of the additional pulleys is a one-way pulley which rotates in one direction only. By using a one-way pulley, the advantages of a block and tackle arrangement are achieved when the load is raised, and when the load is lowered, a frictional force is produced because the one-way pulley cannot turn. Therefore, the rope slides over the pulley's surface creating friction. This allows the load to be lowered at a steady rate.

SUMMARY OF THE INVENTION

The present invention is directed to a device for raising and lowering a load in which a braking device, a braking device indicator and a one-way pulley are used.

Generally, the present invention relates to a device for raising and lowering a load having a braking means for braking the device. In addition, the device includes an indicator flag which indicates when the braking means is enabled. The device also includes a pulley which only rotates when the load is advanced in a selected direction.

BRIEF DESCRIPTION OF THE DRAWINGS

FIG. 1 is an elevation view of a preferred embodiment of the invention attached to a load.

FIG. 2 is an elevation view of the preferred embodiment of the invention.

FIG. 3 is a cross-sectional view taken along line 3—3 of FIG. 2.

FIG. 4 is an exploded perspective view of a cam and a pulley of the embodiment of FIG. 2.

FIG. 7 is a sectional view taken along line 5—5 of FIG. 3 showing the operation of a braking system when a load is lowered at a speed above a selected threshold.

FIG. 10 is an elevation view of a brake indicator system of the preferred embodiment showing a brake indicator flag in a position indicating that the braking system is disabled.

FIG. 11 is an elevation view of a brake indicator system of the preferred embodiment showing a brake indicator flag in a position indicating that the braking system is enabled.

DETAILED DESCRIPTION OF THE PRESENTLY PREFERRED EMBODIMENTS

Figure 5:
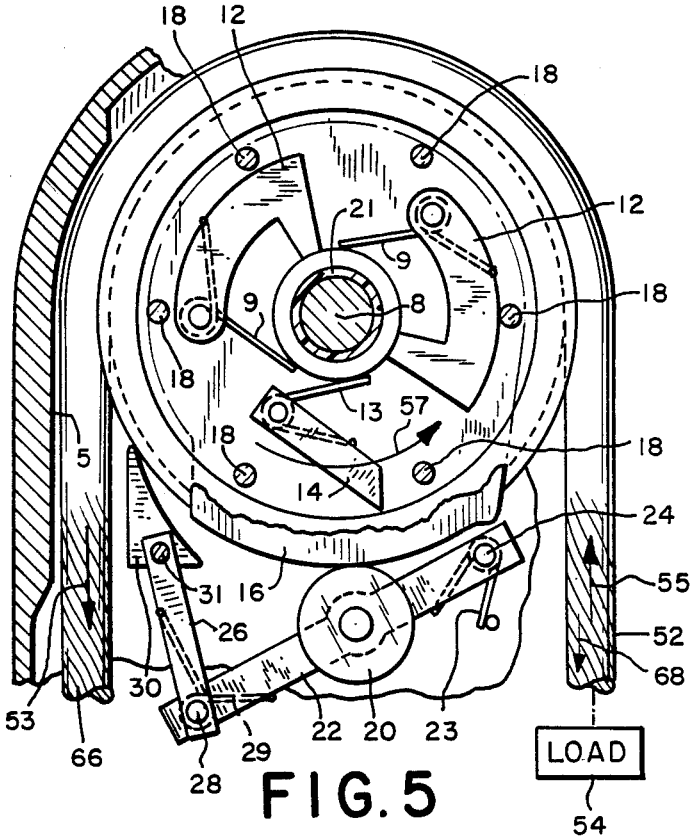
FIG. 5 is a sectional view taken along line 5—5 of FIG. 3 showing a braking system of the preferred embodiment when it is disabled.

Referring now to the drawings, FIGS. 2 and 3 show a preferred embodiment of the invention. A raising and lowering device is generally shown at 2. The device includes a housing 4, a main pulley 6, a cam 16, a cam follower 20, a braking element 30, and a one-way pulley 40. The housing 4 is preferably made of aluminum and defines a braking surface 5. Integrally attached to the housing 4 is a mounting extension 3 which defines an aperture 11. A mounting device 15, such as a hook or a rope, engages the mounting extension 3, through the aperture 11. In this manner the raising and lowering device may be mounted in a variety of locations.

The main pulley 6 is preferably made of aluminum and is rotatably attached to the housing 4 by a main pulley shaft 8 and a plain bearing 21 which pass through aperture 7. As best seen in FIG. 4, the main pulley 6 has a bore 10. Rotatably attached to the main pulley 6, within the bore 10, are overspeed pawls 12 and a ratchet pawl 14. Preferably, the overspeed pawls 12 and the ratchet pawl 14 are made of bronze. As best seen in FIG. 5, torsion wire springs 9 bias the overspeed pawls 12 radially inward, toward the center of the main pulley 6. Torsion wire spring 13 biases the ratchet pawl 14 radially outward toward the inner surface of the bore 10. A cam 16 having extensions 18 is positioned around the main pulley shaft 8 by means of an aperture 19 so that the extensions 18 extend into the bore 10. As best seen in FIGS. 10 and 11, the cam 16 has a rib 17. Preferably the cam 16, the extensions 18 and the rib 17 are forged as a single unit and are made of steel.

Figure 6:
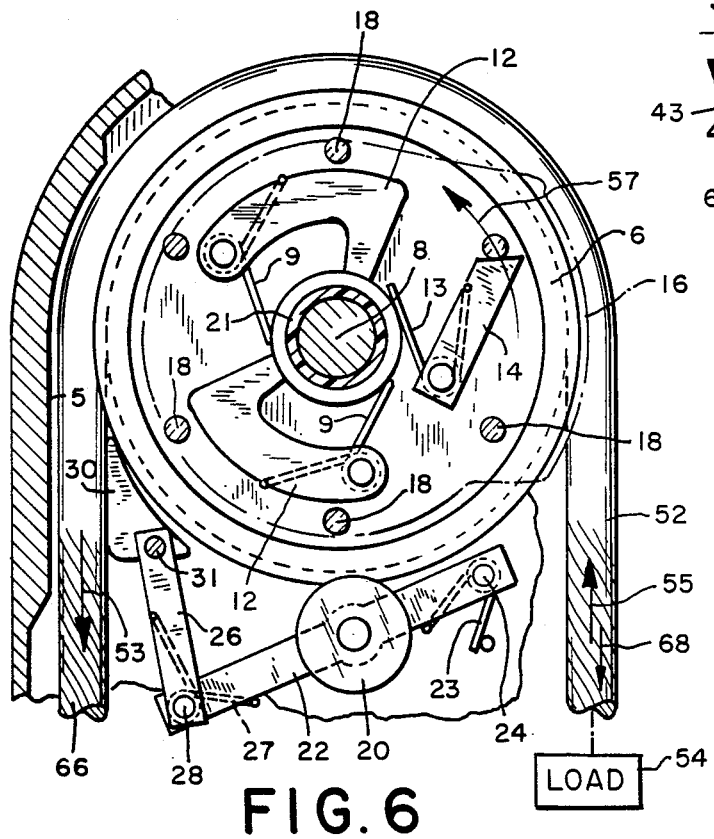
FIG. 6 is a sectional view taken along line 5—5 of FIG. 3 showing a braking system of the preferred embodiment when it is enabled.

As best seen in FIGS. 5, 6, and 7, a cam follower 20 is rotatably attached to a pivot arm 22 which is rotatably attached to the housing 4 by a pivot shaft 24. Preferably the cam follower 20 is circular and is made of brass. A torsion wire spring 23 biases the pivot arm 22 toward the main pulley 6. A pivot arm extension 26 is rotatably attached to the pivot arm 22 by a pivot shaft 28. A braking element 30, preferably wedge-shaped, is attached to the pivot arm extension 26. Preferably, the pivot arm 22, the pivot arm extension 26, and the braking element 30 are made of steel and the braking element 30 is attached to the pivot arm extension 26 by a screw 31. A torsion wire spring 29 biases the pivot arm extension 26 toward the main pulley 6.

As best seen in FIGS. 10 and 11, a brake indicator 32, preferably made of aluminum, is rotatably attached to the housing 4 about a boss 34. The boss 34 is integral with the housing 4 and receives the pivot shaft 24. The brake indicator 32 has a colored flag region 36, a non-colored region 37 and a lever 33. The housing 4 has a flag window 38 which exposes a portion of the brake indicator 32. An extension spring 35 biases the brake indicator 32 in a counterclockwise direction 39.

Figure 9:
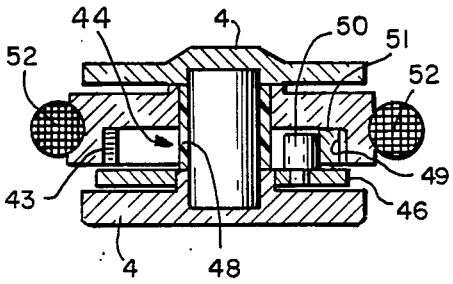
FIG. 9 is a cross-sectional view taken along line 9—9 of FIG. 8.
Figure 8:
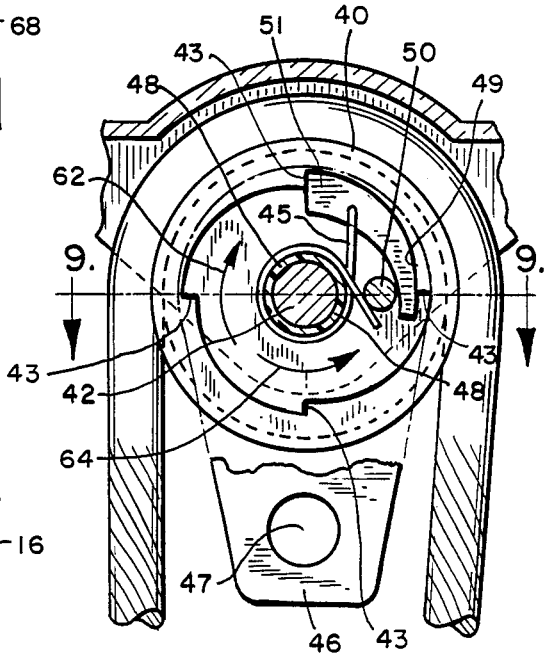
FIG. 8 is a detailed representation of a one-way pulley of the preferred embodiment.

As shown in FIGS. 8 and 9, a one-way pulley 40 is attached to the housing 4 by a one-way pulley shaft 42 and a plain bearing 48. The one-way pulley 40 is preferably made of aluminum and has a bore 44 which defines a braking surface 49. The braking surface 49 includes a plurality of ratchet teeth 43. A hanger plate 46 is fixedly retained adjacent to the one-way pulley 40, around the one-way pulley shaft 42. Preferably, bosses, not shown, on the housing 4 are located on either side of the hanger plate 46 to hold the hanger plate 46 in a fixed position. The hanger plate 46 has an aperture 47 for receiving a hook or ring, such as a carabiner, not shown. A hanger stop pin 50 is welded to the hanger plate 46, and extends into the bore 44. A braking element 51, preferably sickle-shaped, is also located in the bore 44. A torsion spring 45 biases the braking element 51 toward a position between the hanger stop pin 50 and the braking surface 49. Preferably, the hanger plate 46, the hanger stop pin 50, and the braking element 51 are made of stainless steel.

A cord 52, which is preferably KMIII static Kernmantle rope made by New England Ropes of New Bedford, Mass., but may be a cable or another similar object made of flexible material, is received by the housing 4, around the main pulley 6. A load 54 is connected to one end of the cord 52. The load may be an animate or an inanimate object, including a person, a rescue chair, a safe, or a crate. The other end of the cord is connected to a pulling device 56, preferably a man.

FIG. 1 shows the preferred embodiment of the invention attached to a load 54. An auxiliary pulley 58 is contained within an auxiliary pulley housing 60. The auxiliary pulley housing 60 is attached to the load 54. The cord 52 is fixedly attached to the auxiliary pulley housing 60 and engages the one-way pulley 40, and the auxiliary pulley 58 before engaging the main pulley 6. Preferably, the pulling device 56 always acts on the part 66 of the cord 52 that extends from the the housing 4 where the braking element 30 is located.

As shown in FIG. 6, as the pulling device 56 pulls on the cord 52 in a downward direction 53, the load 54 is raised in an upward direction 55. While the pulling device 56 is pulling on the cord 52, the main pulley 6 rotates in a counterclockwise direction 57 about the main pulley shaft 8. As the main pulley 6 rotates in this manner the ratchet pawl 14 engages one of the extensions 18 and forces the cam 16 to rotate with the main pulley 6. As the cam 16 rotates, it intermittently engages the cam follower 20. As best shown in FIG. 5, when engaged by the cam 16, the cam follower 20 forces the pivot arm 22 and the pivot arm extension 26 to rotate in a counterclockwise direction 57 about the pivot shaft 24. This movement of the pivot arm extension 26 coupled with the force due to the wire torsion spring 29 pulls the braking element 30 out of a braking position. Therefore, when the cam 16 is engaging the cam follower 20, the braking system, also referred to as the cord restraining system, is disabled.

As best seen in FIGS. 10 and 11, as the cam 16 rotates in a counterclockwise direction 57, the cam rib 17 intermittently engages the brake indicator lever 33. The brake indicator lever 33 is engaged at approximately the same time that the cam follower 20 is engaged. As the cam rib 17 engages the lever 33, the brake indicator 32 is rotated in a clockwise direction 27 about the boss 34. As the brake indicator 32 is rotated, the brightly colored flag region 36 is positioned so that it is visible through the flag window 38. Therefore, when the braking system is disabled, the colored flag region 36 is visible through the flag window 38. By reversing the regions 36,37, the colored flag region 36 will be visible when the braking system is enabled. Thus the brake indicator 32 indicates the operational status of the braking system.

As best seen in FIG. 6, when the braking element 30 is in the braking position, the braking system is enabled and the cord 52 is prevented from advancing in a direction 68 that would lower the load 54. When the braking element 30 is in the braking position, and the cord 52 is released, the braking element 30 is forced between the cord 52 and the main pulley 6 by the frictional force of the cord 52 against the braking element 30 and the force of the torsion spring 23. As the braking element 30 is forced between the cord 52 and the main pulley 6, the cord 52 is forced against the braking surface 5. This force is sufficient to hold the cord 52 so that it cannot advance in the load-lowering direction 68, thus braking the cord 52.

As best seen in FIG. 5, if the braking element 30 is not in the braking position because the cam 16 has engaged the cam follower 20, then the load 54 may be advanced in the load-lowering direction 68. As the load 54 is lowered, the cord 52 engages the main pulley 6, causing it to rotate in a counterclockwise direction 57. As the main pulley 6 rotates the cam 16 remains stationary due to the frictional force created between the cam 16 and the cam follower 20 and between the cam 16 and the main pulley shaft 8. Due to the shape of the ratchet pawl 14 and the force of the torsion wire spring 13, the ratchet pawl 14 does not engage the extensions 18. Instead, the cam extensions 18 displace the ratchet pawl 14 as it is rotated by the main pulley 6. Therefore, the braking system remains disabled as the load 54 is lowered.

As best seen in FIG. 7, if the load 54 is lowered or the pulling device 56 completely releases the cord 52, causing the load 54 to drop rapidly, then the main pulley 6 rotates in a clockwise direction 59. If the load 54 drops at a rate above a selected speed, preferably 3 feet/sec., then the main pulley 6 will rotate above a selected speed, preferably 450 rpm, thus producing a centrifugal force great enough to overcome the biasing force of the springs 9 attached to the over-speed pawls 12. This centrifugal force causes the over-speed pawls 12 to extend outward and engage at least one of the extensions 18. Once an extension 18 is engaged by an over-speed pawl 12, the cam rotates with the main pulley 6 and disengages the cam follower 20, thus bringing the braking element 30 back into the braking position. This action stops the movement of the cord 52 in the load-lowering direction 68 and thus stops the lowering of the load 54. This type of over-speed protection device is well-known to those skilled in the art.

Turning now to the operation of the one-way pulley 40, as best shown by reference to FIGS. 8 and 9, when the one-way pulley 40 attempts to turn in the clockwise direction 62, the braking element 51 is forced between the hanger stop pin 50 and the braking surface 49 of the one-way pulley 40 by one of the ratchet teeth 43 and by the force of the spring 45. When the one-way pulley 40 turns in the counterclockwise direction 64, the friction from the braking surface 49 forces the braking element 51 to retract slightly from between the hanger stop pin 50 and the braking surface 49. This allows the one-way pulley 40 to freely rotate in the counterclockwise direction 64.

The one-way pulley 40 may be used to reduce the difficulty encountered when the load 54 is lowered by a man. The one-way pulley is positioned as shown in FIG. 1 so that it only rotates in a counterclockwise direction 64. When the load 54 is raised, the one-way pulley 40 rotates freely and reduces the force necessary to raise the load 54. When the load 54 is lowered, the one-way pulley does not rotate and a frictional force is created as the cord 52 slides over the one-way pulley 40. This frictional force reduces the upward force experienced at the rope side 66 and makes it easier for the pulling device 56 (in this case a man) to ease the load 54 down gently at a constant rate.

Of course, it should be understood that various changes and modifications to the preferred embodiment described herein will be apparent to those skilled in the art. It is therefore intended that the foregoing detailed description be regarded as illustrative rather than limiting, and that it be understood that it is the following claims, including all equivalents, which are intended to define the scope of this invention.

I claim:

1. A device for raising and lowering a load, said device comprising:

a cord adapted to be connected to means for raising the load and adapted to be connected to the load, a housing, a pulley rotatably mounted on said housing and having a cord receiving surface, said cord being trained over said cord receiving surface and movable in a load lowering direction and in a load raising direction, braking means on said housing, adjacent said cord, and intermittently enabled by the rotation of said pulley as the load is being raised for preventing movement of said cord in said load lowering direction, means for intermittently enabling said braking means in response to rotation of said pulley, and displaying means movably mounted on said housing and responsive to said braking means being enabled for visually displaying when said braking means is enabled.

2. A device in accordance with claim 18 wherein said braking means includes a member rotatably mounted on said housing, and means for selectively rotating said member with said pulley, and wherein said displaying means comprises a rib located on said member, and a brake indicator movably mounted on said housing adjacent said braking means member, and including a lever, so that said rib engages said lever when said braking means is enabled, thereby moving said brake indicator to an operator visible position to indicate that said braking means is enabled.

3. The device of claim 2 wherein said brake indicator comprises a brightly colored flag region.

4. The device of claim 3 further comprising means for exhibiting said brightly colored flag region when said braking means is enabled.

5. A device in accordance with claim 4 wherein said exhibiting means comprises a window in said housing through which said brightly colored flag region is visible.

6. The device of claim 3 further comprising means for exhibiting said brightly colored flag region when said braking means is disabled.

7. A device in accordance with claim 6 wherein said exhibiting means comprises a window in said housing through which said brightly colored flag region is visible.

8. A device in accordance with claim 1, wherein said housing has a braking surface adjacent said cord, and wherein said braking means includes a cam rotatably mounted on said housing, and having an enlarged radius portion, a cam follower movably mounted on said housing and intermittently engageable by said enlarged radius portion, a braking element adjacent said cord on a side opposite said housing braking surface, means for rotating said cam with said pulley when said pulley rotates in said load-raising direction, and for permitting said cam to remain stationary when said pulley rotates in said load-lowering direction, and linkage means connecting said braking element to said cam follower for positioning said braking element when said cam follower is engaged by said enlarged radius portion so that said cord, when moved in said load-lowering direction, is wedged between said braking element and said braking surface.

9. A device in accordance with claim 8 wherein said cam is rotatable coaxially with said pulley.

10. A device in accordance with claim 1, wherein said housing includes means for holding said housing in a fixed position, and wherein said pulley is rotatably mounted in a fixed position and said housing.

11. A device for raising and lowering a load, said device comprising:

a cord adapted to be connected to the load and to means for raising the load, a housing having a braking surface adjacent said cord, a pulley rotatably mounted on said housing said having a cord-receiving surface, said core being trained over said cord-receiving surface and movable in a load-lowering direction and in a load-raising direction, and braking means on said housing, adjacent said cord, for preventing movement of said cord in said load-lowering direction, said braking means including a cam rotatably mounted on said housing, and having an enlarged radius portion, a cam follower movably mounted on said housing and engageable by said enlarged radius portion, a braking element adjacent said cord on a side opposite said housing braking surface, means for rotating said cam with said pulley when said pulley rotates in said load-raising direction, and for permitting said cam to remain stationary when said pulley rotates in said load-lowering direction, and linkage means connecting said braking element to said cam follower for positioning said braking element when said cam follower is engaged by said enlarged radius portion so that said cord, when moved in said load-lowering direction, is wedged between said braking element and said braking surface.

12. A one-way pulley comprising:

a hanger plate, a pulley cylinder rotatably mounted on said hanger plate, and having a cord-receiving surface, and a bore which defines a radially inward braking surface opposite said cord receiving surface, a stop pin fixed on said hanger plate, located within said pulley bore, and spaced from said braking surface, a braking element having a narrow end narrower than the space between said braking surface and said stop pin, and a wider end wider than the spacer between said braking surface and said stop pin, means locating said braking element within said pulley bore, and between said braking surface and said stop pin, and means for wedging said braking element wider end between said braking surface and said pin when said pulley cylinder is rotated in one direction, and for forcing said braking element to retract slightly from between said braking surface and said pin to allow free rotation of said pulley cylinder when said pulley cylinder is rotated in an opposite direction.

13. A pulley in accordance with claim 12 wherein said wedging means comprises a plurality of ratchet teeth on said braking surface and which engage said wider end of said braking element when said pulley cylinder is rotated in said one direction.

14. A pulley in accordance with claim 12 wherein said locating means comprise a tension spring mounted on said hanger plate.

15. The pulley of claim 14 wherein said braking is resiliently biased to a position between said pin and said braking surface by said locating means.

* * * * *